United States Patent [19]

De Mooij et al.

[11] Patent Number: 4,935,074

[45] Date of Patent: Jun. 19, 1990

[54] MAGNETIC MATERIAL COMPRISING IRON, BORON AND A RARE EARTH METAL

[75] Inventors: Dirk B. De Mooij; Kurt H. J. Buschow, both of Eindhoven, Netherlands

[73] Assignee: U.S. Philips Corporation, New York, N.Y.

[21] Appl. No.: 419,869

[22] Filed: Oct. 11, 1989

Related U.S. Application Data

[63] Continuation-in-part of Ser. No. 179,108, Apr. 8, 1988, abandoned, which is a continuation-in-part of Ser. No. 108,509, Oct. 13, 1987, abandoned.

[30] Foreign Application Priority Data

Oct. 10, 1986 [NL] Netherlands ..... 8602541

[51] Int. Cl.[5] ..... H01F 1/04

[52] U.S. Cl. ..... 148/302; 420/83; 420/121

[58] Field of Search ..... 148/302, 83, 121

[56] References Cited

U.S. PATENT DOCUMENTS 4,533,408 8/1985 Koon ..... 148/103

FOREIGN PATENT DOCUMENTS 60-162750 8/1985 Japan .

*Primary Examiner*—John P. Sheehan
*Attorney, Agent, or Firm*—Norman N. Spain

[57] ABSTRACT

A magnetic material of the composition $Fe_{79-x-y}B_{21+x}R_y$ in which R is a rare earth element or a mixture of such elements and wherein $-5<x<5$ and $<y\leqq+4.8$ The preferred rare earth element is neodymium and/or praseodymium.

6 Claims, No Drawings

MAGNETIC MATERIAL COMPRISING IRON, BORON AND A RARE EARTH METAL

This application is a continuation-in-part of application Ser. No. 179,108 filed Apr. 8, 1988, which application Ser. No. 179,108 is a continuation-in-part of application Ser. No. 108,509, filed Oct. 13, 1987 and now abandoned.

The invention relates to a magnetic material, comprising iron, boron and one or more rare earth elements. Magnetic materials based on the said elements are known; see, for example, Materials Letters 2, pp. 411–5 (1984), Stadelmaier, Elmassy, Liu and Cheng, entitled "The metallurgy of the Iron-Neodymium-Boron-permanent magnet system". The known material consists mainly of tetragonal crystals of $Nd_2Fe_{14}B$ embedded in a neodymium-rich second phases. This applies to materials which comprise praseodymium as a rare earth element. Materials of this type poorly withstand corrosion as a result of the presence of a second phase which is rich in the rare earth element. If a gross composition is chosen in such a manner that the second phase which is rich in rare earth element is not formed, the coercive force of the material is negligible (see page 415 of the paper).

It is the object of the invention to provide magnetic materials of the said composition which have such a coercive force that they are technically useful and can withstand corrosion better than the said materials.

The invention is based on the discovery that materials having approximately the gross composition $Fe_3B$ which in themselves are soft magnetic and in the equilibrium condition at room temperature consist of $\alpha$-Fe and $Fe_2B$ (see, for example, GB No. 1,598,886) can obtain permanent magnetic properties by comparatively small additions of rare earth elements.

The material according to the invention is characterized in that the gross composition satisfies the formula $$Fe_{79-x-y}B_{21+x}R_y$$

wherein R is a rare earth element and in which it holds that $-5<x<+5$ and $+1<y\leqq+4.8$. As a result of the presence of a comparatively small quantity of rare earth element which in no case exceeds 4.8 at. %, the materials prove to have a coercive force $H_c$ of approximately 2 to 3.5 k Oe; for comparison: a material having a comparable gross composition of $Fe_{77}B_{23}$ provides a coercive force not higher than 800 A/m (=0.01 k Oe), see "Behavior of glassy $Fe_{77}B_{23}$ upon anneal in the absence of externally applied fields" by Ramanan, Marti and Macur in J. Appl. Physics 52 (3), pp. 1874–6 (1981).

When the boron content is increased or decreased beyond the indicated range of compositions, the compounds $Fe_2B$, $Nd_{11}Fe_4B_4$ and iron, respectively, prove to occur as contamination phases. When the rare earth element content increases, upon crystallization, rare earth metal-rich crystalline second phases and iron are segregated as a result of which the material becomes sensitive to corrosion. X-ray examination has proved that the material comprises only one crystalline phase having the $Fe_3B$ structure. If no rare earth element is present, said structure at room temperature is metastable, see, for example, Zts. f. Metallkunde 73, p. 6246 (1982). "The phase $Fe_3B$" by Khan, Kneller and Sostarich.

The materials according to the invention can be obtained as follows:

The starting substances are melted in the desired quantities under a protective gas (for example, argon). The melt is then cooled rapidly, flakes of amorphous material being formed, for example, by means of the so-called melt-spinning process. The flakes are then subjected to a thermal treatment to induce crystallization. It was found that any composition in the specified range has its associated specific temperature treatment in which a maximum coercive force is obtained. This heat treatment can be determined by means of some simple experiments. Materials having the maximum possible coercive force proved to be single-phase materials on X-ray examination. When the heat treatment is continued, the coercive force decreases, which apparently is caused by the occurrence of a phase separation. The flakes may then be bonded with a synthetic resin to form a magnet or may be compressed as such at a higher temperature to form a magnet.

The rare earth element in the composition according to the invention preferably is neodymium and/or praseodymium. The thermal treatment of the flakes may consist of a method, for example, in that which the flakes are heated to 720° C. and are then cooled in a protective gas or, for example, are heated at 525° C. in a vacuum for 20 hours and are then cooled in a vacuum.

In this manner, technically useful synthetic resin-bonded magnets can be produced which, because of the low content of rare earth metal, for example, neodymium and/or praseodymium, are comparatively cheap. Generally, the materials have a remanence exceeding 0.5.

In the table below, a number of magnetic materials which were manufactured in the above-specified manner with the measured coercive forces are indicated by way of example.

TABLE 1

| Gross composition | x | y | coercive force | heat treatment |
|---|---|---|---|---|
| 1. $Pr_{3.8}Fe_{77.0}B_{19.2}$ | −1.8 | 3.8 | 3 | 20 hrs at |
| 2. $Pr_{4.1}Fe_{77}B_{18.9}$ | −2.1 | 4.1 | 3 | 525° C. |
| 3. $Nd_{3.8}Fe_{77/0}B_{18.9}$ | −1.8 | 3.8 | 2.6 | heated to |
| 4. $Nd_{4.0}Fe_{76.0}B_{20}$ | −1 | 4 | 2 | 720° (20° C./min) |

Table 2 illustrates the effect of various heat treatments on the coercive force.

TABLE 2

| Gross composition | T. in °C. | duration in min. | coercive force in k Oe |
|---|---|---|---|
| $Nd_{3.8}Fe_{77}B_{19.2}$ | 615 | 30 | 2.9 |
| x = −1.8 | 625 | 30 | 3.2 |
| y = 3.8 | 635 | 30 | 3.0 |
| Curie temp: 800° C. | 655 | 30 | 2.2 |
| | 720 | 15 | 3.0 |
| | 625 | 60 | 2.5 |
| $Nd_2D_2Fe_{77.6}B_{18.4}$ | 615 | 30 | 1.9 |
| x = −2.6 | 620 | 30 | 2.8 |
| y = 4 | 632 | 30 | 2.9 |
| | 650 | 30 | 3.25 |
| | 654 | 30 | 3.2 |
| | 662 | 30 | 3.1 |
| | 680 | 30 | 2.65 |

The effect of employing the rare earth in an amount of 5 atomic percent or higher compared to a material of the invention employing 4.8 atomic percent of the rare earth is shown in the following example and table.

Fe, B, and Nd were melted under argon in quantities corresponding to the following compositions:

| Composition | |
|---|---|
| 5 | $Nd_{4.8}Fe_{78.2}B_{17}$ |
| 6 | $Nd_{5.0}Fe_{77}B_{18}$ |
| 7 | $Nd_{5.5}Fe_{78.3}B_{16.2}$ |
| 8 | $Nd_{6.0}Fe_{77}B_{17}$ |

The results were cooled rapidly by means of melt spinning procedure result in the formation of flakes. These flakes were heated at a temperature of 680° C. for 30 minutes to induce crystallization.

The coercive force of these materials was determined by a measurement of the field dependence of the magnetization, using a Vibrating Sample Magnetometer. The results were as follows:

TABLE 3

| Composition | $H_c$ in kOe |
|---|---|
| 5 | 2.8 |
| 6 | 1.8 |
| 7 | 1.2 |

TABLE 3-continued

| Composition | $H_c$ in kOe |
|---|---|
| 8 | 0.4 |

What is claimed is:

1. A magnetic material comprising iron, boron and at least one rare earth element, characterized in that the magnetic material has the composition $Fe_{79-x-y}B_{21+x}R_y$ wherein R is at least one rare earth element and wherein $-5<x<+5$ and $+1<y\leqq+4.8$.

2. A magnetic material as claimed in claim 1, characterized in that R is Nd and/or Pr.

3. A magnetic material comprising iron, boron and at least one rare earth element, characterized in that the magnetic material has the composition $Fe_{79-x-y}B_{21+x}R_y$, wherein R is at least one rare earth element comprising at least one member selected from the group consisting of Nd and Pr and wherein $-5<x<+5$ and $y=3.8-4.1$.

4. Magnets formed from a material as claimed in claim 1.

5. Magnets formed from a material as claimed in claim 2.

6. Magnets formed from a material as claimed in claim 3.

* * * * *